US006864869B2

(12) United States Patent
Udo et al.

(10) Patent No.: US 6,864,869 B2
(45) Date of Patent: Mar. 8, 2005

(54) DATA DRIVER AND DISPLAY UTILIZING THE SAME

(75) Inventors: Shinya Udo, Kawasaki (JP); Osamu Kudo, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 68 days.

(21) Appl. No.: 09/732,700

(22) Filed: Dec. 11, 2000

(65) Prior Publication Data

US 2002/0008684 A1 Jan. 24, 2002

(30) Foreign Application Priority Data

Jul. 18, 2000 (JP) ..... 2000-217894

(51) Int. Cl.[7] ..... G09G 3/36
(52) U.S. Cl. ..... 345/89; 345/90
(58) Field of Search ..... 345/204, 89, 100, 345/210, 209, 96; 324/73.1; 323/318

(56) References Cited

U.S. PATENT DOCUMENTS 5,113,134 A * 5/1992 Plus et al. ..... 324/73.1
5,625,373 A * 4/1997 Johnson ..... 345/100
5,625,387 A * 4/1997 Moon ..... 345/209
5,627,457 A * 5/1997 Ishiyama et al. ..... 323/318
6,028,598 A * 2/2000 Suyama et al. ..... 345/210
6,151,005 A * 11/2000 Takita et al. ..... 345/89
6,172,663 B1 * 1/2001 Okada et al. ..... 345/96
6,310,616 B1 * 10/2001 Yanagi et al. ..... 345/204

* cited by examiner

*Primary Examiner*—Chanh Nguyen
*Assistant Examiner*—Uchendu O. Anyaso
(74) *Attorney, Agent, or Firm*—Arent Fox PLLC

(57) ABSTRACT

The present invention provides a data driver on which an operation test can be easily and reliably conducted at the stage of manufacture and for which the testing time can be reduced and a display utilizing the same. A select switch portion 60 is provided for electrically connecting and disconnecting a ladder resistor portion 56 and selector portions 58. At the ends of wiring of grayscale voltage lines l1 through l64 opposite to the ladder resistor portion 56, there is provided a state setting circuit 62 which sets each of the grayscale lines l1 through l64 at a "High" level or a "Low" level or which sets the ends of the grayscale voltage lines l1 through l64 in a high impedance state. The state setting circuit 62 is further connected to a testing control portion 64 incorporating a shift register which operates in synchronism with a test clock TST-CLK.

10 Claims, 7 Drawing Sheets

16-1
Reset
TST-CLK
64
H1
H2
H3
H4
H62
H63
H64
62
C1
C2
C3
C4
C62
C63
C64
50
52
Vs
m-th Stage
First Stage
DCLK
TDCLK
Rd(0~5)
Gd(0~5)
Bd(0~5)
Vch
S1-m
S2-m
S3-m
S62-m
S63-m
S64-m
S1-1
S2-1
S3-1
S62-1
S63-1
S64-1
58
54
Out m
Out 1
Tr1
Tr2
Tr3
Tr4
Tr5
Tr6
IS1
IS2
IS3
IS4
IS62
IS63
IS64
60
56
V0
R1
R2
R3
R62
R63
V63

DATA DRIVER AND DISPLAY UTILIZING THE SAME

BACKGROUND OF THE INVENTION

1. Field of the Invention

The present invention relates to a data driver for outputting an analog grayscale voltage to each data bus line and a display utilizing the same.

2. Description of the Related Art

An example of a configuration of a liquid crystal display panel having conventional data drivers loaded thereon will be described with reference to FIG. 6. FIG. 6 shows a schematic configuration of a conventional liquid crystal display panel 101 having thin film transistors (TFTs) whose channel layers are formed from, for example, amorphous silicon (a-Si) as switching elements. A plurality of data bus lines Ld extending in the vertical direction of the figure are formed in a display area 90 of the panel 101 in parallel in the lateral direction of the figure, and a plurality of gate signal lines (not shown) extending in a direction substantially perpendicular to the data bus lines Ld are formed in parallel in the vertical direction of the figure. Each of the data bus lines Ld is connected to any of data drivers 103 through 117 to be driven thereby. Each of the plurality of gate signal lines is driven by a gate driver which is omitted in the figure.

For example, in the case of a color display which is a panel for displaying a matrix consisting of 800 horizontal pixels and 600 vertical pixels, i.e., an SVGA (super video graphics array) and in which one pixel is formed by three subpixels, i.e., red (R), green (G) and blue (B) pixels, the number of subpixels displayed on one gate signal line (scan line) is 2400 (800×3). In order to drive the liquid crystal display 101 using a line sequential driving method, for example, four of the eight data drivers 103 through 117 each of which is capable of driving 300 data bus lines Ld are mounted at each of the upper and lower ends of the data bus lines Ld. The data bus lines Ld are sequentially alternately connected to the data drivers 103 through 117 provided at the upper and lower parts of the panel, for example, in the left-to-right direction of the figure.

Let us assume that the data bus lines Ld are numbered starting with the leftmost line in the figure. Then, the data driver 103 drives data bus lines Ld with odd numbers from 1 to 599, and the data driver 111 drives data bus lines Ld with even numbers from 2 and 600. Similarly, the data drivers 105, 107 and 109 drive data bus lines Ld with odd-numbers from 601 to 1199, from 1201 to 1799 and from 1801 to 2399 respectively, and the data drivers 113, 115 and 117 drive data bus lines Ld with even numbers from 602 to 1200, from 1202 to 1800 and from 1802 to 2400 respectively.

Display data for one scan line are normally output from a system such as a computer connected to the liquid crystal display 101 in the (ascending or descending) order of the numbers of the data bus lines Ld. Therefore, there is separately provided an allocation circuit 119 for allocating each item of the display data to any of the data drivers 103 through 117 such that each item of the display data is output from a predetermined data bus line Ld. Display data in three colors R, G and B for each pixel transmitted from the system are input to the data drivers 103 through 117 as digital data having a number of bits corresponding to the number of grayscales to be displayed whether the data are analog data or digital data.

The data drivers 103 through 117 shown in FIG. 6 have the same configuration, and a schematic structure of the same will be described using FIG. 7 with reference to the data driver 103 as an example. The data driver 103 has a shift register 500 to which digital grayscale data Data are input. For example, the grayscale data Data are red (R) data Rd (0–5), green (G) data Gd (0–5) and blue (B) data Bd (0–5) each of which consists of six bits, which allows 64 grayscales to be displayed for each of the colors.

For example, the shift register 500 comprises 300 stages to allow grayscale data to be output to 300 data bus lines by one data driver 103. The shift register 500 sequentially fetches the grayscale data Data into the stages in synchronism with dot clocks DCLK transmitted from a control portion which is not shown.

An output terminal of each of the first through 300th stages of the shift register 500 is connected to a latch circuit 502 provided downstream thereof. When a latch pulse LP is output with the grayscale data Data stored in all stages of the shift register 500, the latch circuit 502 latches the grayscale data in each stage of the shift register 500.

A reference voltage selection circuit is provided downstream of the latch circuit 502. The reference voltage selection circuit has one ladder resistor portion 506 for supplying 64 voltage levels to the data bus lines and a selector portion 508 provided for each data bus line.

The ladder resistor portion 506 is provided by connecting 63 resistors R1 through R63 in series. A voltage V0 is applied to one terminal of the resistor R1, and a voltage V63 is applied to one terminal of the resistor R63. A grayscale voltage line l1 for supplying the voltage V0 to the selector portions 508 is extended from the ladder resistor portion 506. A grayscale voltage line l64 for supplying the voltage V63 to the selector portions 508 is also extended. Grayscale voltage lines l2 through l62 are extended from connecting points between the adjoining resistors by connecting taps thereto, and 64 voltage levels from the voltage V0 up to the voltage V63 are supplied to the selector portions 508 through the grayscale voltage lines l1 through l64 as a result of resistance division.

The selector portions 508 will now be described. For example, the selector portion 508 for the first data bus line has 64 decoders S1-1 through S64-1. Each of the decoders S1-1 through S64-1 has six switching elements Tr1 through Tr6 which are constituted by, for example, p-channel type MOSFETs. The drain electrodes of the first switching elements Tr1 provided at the decoders S1-1 through S64-1 are sequentially connected to the 64 grayscale voltage lines l1 through l64 extended from the ladder resistor portion 506.

The source electrodes of the switching elements Tr1 are connected to the drain electrodes of the switching elements Tr2 at the subsequent stages. Similarly, the switching elements Tr1 through Tr6 are connected in series in the order listed, and the source electrode of the switching element Tr6 is connected to a first output line Out1. The output line Out1 is connected to a first data bus line through a buffer 504.

The gate electrode of the switching element Tr1 is connected to either bit lines D1 or /D1 for the first bit of grayscale data consisting of six bits held for the first data bus line in the latch circuit 502. The symbol "/" indicates that the bit line is activated by a signal at a low (L) level. Similarly, the gate electrodes of the switching elements Tr2 through Tr6 of the decoders S1-1 through S64-1 are sequentially connected to bit lines D2 (or /D2) through D6 (or /D6) of the second through sixth bits of the grayscale data consisting of six bits held for the first data bus line in the latch circuit 502.

Although not described in detail, the bit lines D or /D connected to the gate electrodes of the switching elements Tr1 through Tr6 of the decoders S1-1 through S64-1 may be appropriately selected and connected to select one of the voltages at 64 levels in accordance with the grayscale data held in the latch circuit 502. On the first data bus line, for example, all of the switching elements Tr1 through Tr6 of any one of the decoders S1-1 through S64-1 may be turned on in accordance with the grayscale data held in the latch circuit 502, and at least one of the switching elements Tr1 through Tr6 of the other decoders may be turned off.

As a result, a desired analog grayscale voltage can be output to the first data bus line from the grayscale voltage line 1 connected to the decoder whose switching elements Tr1 through Tr6 have been all turned on. A desired analog grayscale voltage can be selected and output to the m-th data bus line through completely the same operation.

The analog grayscale voltage output to the output line Out1 is applied to the drain electrode of a pixel TFT (not shown) connected to the first data bus line through a buffer 504. The grayscale voltages are applied from pixel TFTs which have been turned on by gate pulse transmitted to a predetermined gate bus line to the pixel electrodes respectively, thereby performing grayscale display for one gate bus line.

In order to prevent deterioration of the liquid crystal, a grayscale voltage applied to the liquid crystal is normally subjected to the so-called inversion (alternate) driving in which the polarity of the voltage is inverted for each frame. Therefore, the data drivers have a configuration including a ladder resistor and decoders such that 64 levels each can be output with a positive polarity (+V) and negative polarity (−V) relative to a common potential. For simplicity of description, FIG. 7 shows only the configuration of the positive polarity side.

The data driver is subjected to performance evaluation and functional tests at the final stage of the manufacturing steps. Such evaluation and tests are conducted to detect any defect of the data driver by operating it under conditions which are the same as actual operating conditions. Specifically, 64 kinds of grayscale data are sequentially output to all of the selectors 508, and analog grayscale voltages output by the output lines Out1 through Outm are monitored with a tester. If the level of the output signal from any of the output lines Out1 through Outm falls below a reference level, the data driver is determined as defective.

For example, let us assume that V0=0 V and V63=5 V at the positive polarity side and that V0=0 V and V63=−5 V at the negative polarity side. Then, when there are 64 levels for each polarity as described above, the voltage difference between grayscales is only about 80 mV. Further, when 128 or 256 grayscales are to be achieved, the voltage difference between the grayscales is further reduced to a value in the same from about 20 mV to 40 mV.

Therefore, when the performance evaluation and functional tests of the data drivers are attempted by applying grayscale data sequentially, the small grayscale voltage difference between adjoining grayscales as described above results in a need for testers having excellent display resolving power and relatively high accuracy. This results in a problem in that the cost required for the tests is increased.

Further, the output of the output lines Out1 through Outm must be monitored after the levels of the analog grayscale voltages become sufficiently stable. This has resulted in a problem in that the grayscale data can not be switched at a high speed to conduct the tests in a short time. Furthermore, since the above-described operation must be repeated for a multiplicity of decoders S, a problem arises in that the testing takes a long time.

There is another problem in that a test can not be conducted in which a stress voltage is applied between wirings to reject data drivers having foreign substances that have been deposited between adjoining grayscale voltage lines at manufacturing steps but have not caused any short-circuit as defective products. Thus, a problem can arise in that data drivers which can become defective as time passes are mounted on a liquid crystal panel to cause display defects of the liquid crystal display after the shipment of the product.

SUMMARY OF THE INVENTION

It is an object of the invention to provide a data driver whose operation can be tested in a simple and reliable manner in a shorter testing time and a display utilizing the same.

The above object is achieved by a data driver for outputting a plurality of analog grayscale voltages to a plurality of data bus lines, characterized in that it has a grayscale voltage generating portion for generating the plurality of analog grayscale voltages for a predetermined number of grayscales, a selector portion provided for each of the data bus lines for selecting any one of the plurality of analog grayscale voltages based on grayscale data, a plurality of grayscale voltage lines which are connected to the grayscale voltage generating portion and provided for each of the plurality of analog grayscale voltages and which supply the analog grayscale voltages to the selector portion and a switching portion for electrically disconnecting the grayscale voltage lines from the grayscale voltage generating portion during an operation test.

The operation test can be conducted with the grayscale voltage lines set at arbitrary voltage levels by electrically disconnecting at least a part of or all of the plurality of grayscale voltage lines from the grayscale voltage generating portion during the test. This makes it possible to conduct the operation test easily and reliably in a short time even though the voltage difference between adjoining analog grayscale voltages output from the grayscale voltage generating portion to the grayscale voltage lines is small.

In the data driver according to the invention, the grayscale voltage generating portion is characterized in that it has a ladder resistor portion having a plurality of resistors connected in series to generate the plurality of analog grayscale voltages by means of resistance division. In the data driver according to the invention, the grayscale voltage generating portion is characterized in that it alternatively has a ladder resistor portion having a plurality of transistors connected in series to generate the plurality of analog grayscale voltages by means of resistance division utilizing on resistance of the transistors.

The data driver according to the invention is further characterized in that it has a state setting circuit for allowing each of the plurality of grayscale voltage lines to be independently set at an "H (High)" or "L (Low)" level during the operation test.

The state setting circuit of the data driver according to the invention is characterized in that it maintains the ends of the plurality of grayscale voltage lines in a high impedance state during a normal operation. The state setting circuit is also characterized in that it is provided at the end of wiring of the plurality of grayscale voltage lines opposite to the grayscale voltage generating portion.

The state setting circuit is characterized in that it has a plurality of switching elements for state switching having a CMOS structure whose output end is connected to the end of wiring of each of the plurality of grayscale voltage lines and a plurality of state switching circuits which are connected to input ends of the switching elements for state switching and which set the output state of each of the plurality of switching elements for state switching in an "H", "L" or "Hiz" state.

Alternatively, the state setting circuit is characterized in that it has a plurality of switching elements for state switching which are respectively connected to the plurality of grayscale voltage lines between the grayscale voltage generating portion and the selector portion.

The data driver is characterized in that it has a controller for testing which controls the state setting circuit to sequentially set the plurality of grayscale voltage lines such that only one of them is at the "H" level at a time during the operation test.

With the configuration according to the invention, since the operation test can be conducted with a voltage at the "H" or "L" level applied to each of the plurality of grayscale voltage lines, a data driver can be accurately determined as good or defective in a short time. The configuration according to the invention also makes it possible to conduct the test by applying a stress voltage between wirings because the potential at each of the plurality of grayscale voltage lines can be switched to the "H" or "L" level.

The above object is achieved by a display having a plurality of data bus lines for displaying an image, characterized in that it is loaded with the data driver according to the invention as a data driver for outputting analog grayscale voltages to the plurality of data bus lines.

The present invention makes it possible to reduce the occurrence of problems with liquid crystal displays or the like after shipment because it can prevent any data driver that can become defective as time passed from being loaded in the displays.

DETAILED DESCRIPTION OF THE PREFERRED EMBODIMENTS

Figure 1:
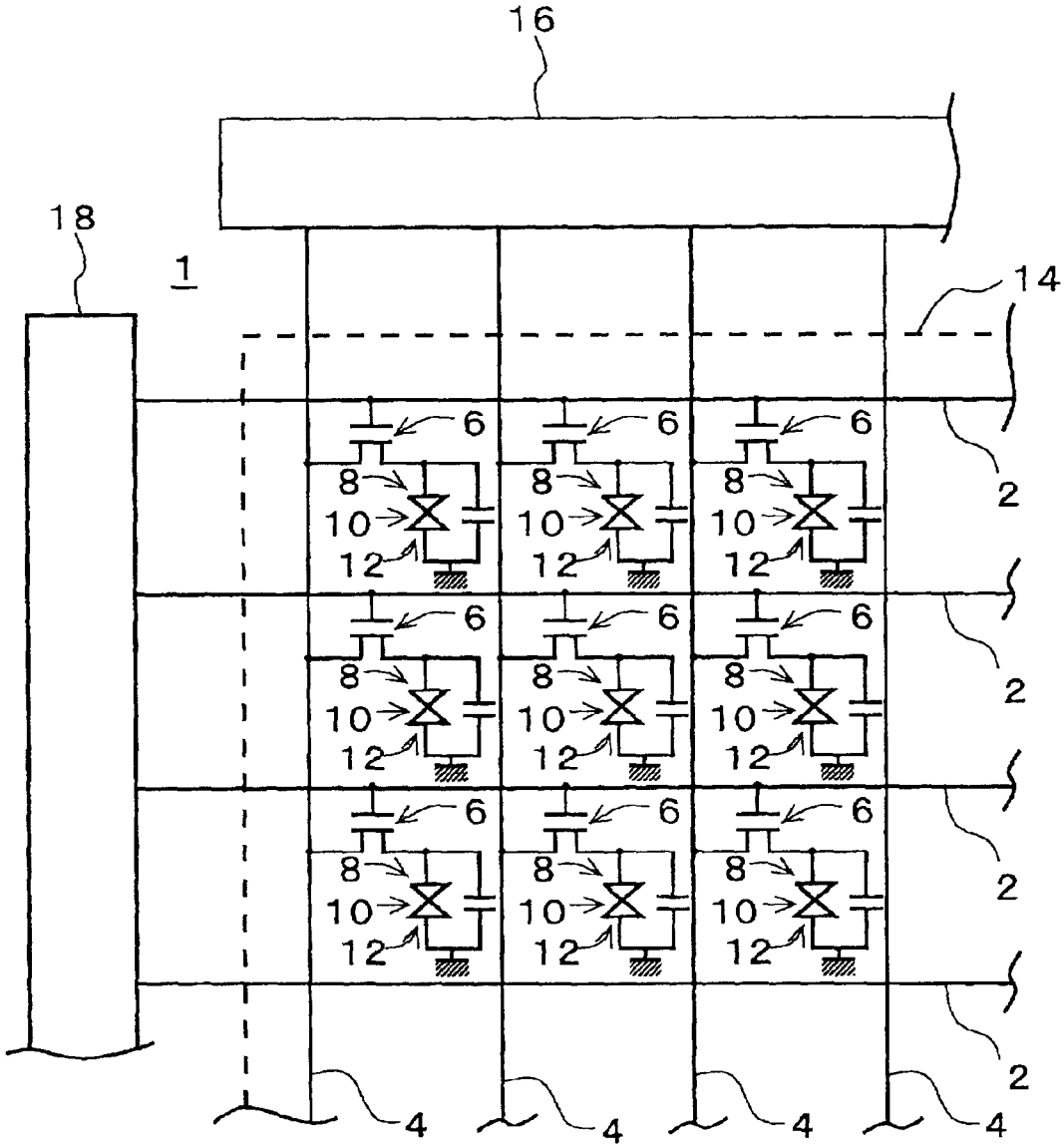
FIG. 1 is an illustration of a schematic configuration of a liquid crystal display according to an embodiment of the invention.

A data driver according to an embodiment of the invention and a liquid crystal display utilizing the same will now be described with reference to FIGS. 1 through 5. First, a brief description will be made with reference to FIG. 1 on a structure of a liquid crystal display which utilizes thin film transistors (TFTs) as switching elements as an active matrix liquid crystal display according to the present embodiment. FIG. 1 shows the liquid crystal display as viewed from above a panel thereof. A liquid crystal is enclosed between two glass substrates, i.e., an array substrate 1 and a counter substrate 14 (edges of which are indicated by a broken line).

For example, a plurality of gate bus lines 2 extending in the lateral direction of the figure are formed on the array substrate 1 in a vertically parallel relationship with each other. A plurality of data bus lines 4 extending in the longitudinal direction of the figure are formed in a laterally parallel relationship with each other with an insulation film (not shown) interposed. Each of plural regions in the form of a matrix defined by the gate bus lines 2 and data bus lines 4 formed in the longitudinal and lateral directions serves as a pixel region. FIG. 1 also shows an equivalent circuit of the liquid crystal display in each of the pixel regions. A pixel electrode 8 is formed in each of the pixel regions.

A TFT 6 is formed in the vicinity of the intersection between the gate bus line 2 and data bus line 4 at each of the pixel regions, and the gate electrode and drain electrode of the TFT 6 are connected to the gate bus line 2 and data bus line 4, respectively. The source electrode is connected to the pixel electrode 8. The gate bus lines 2 are driven by a gate driver 18, and the data bus lines 4 are driven by a data driver 16. A grayscale voltage is output from the data driver 16 to each data bus line 4. When the data driver 16 outputs a grayscale voltage to each of the data bus lines 4 and a gate signal is output to any gate bus line 2, a series of TFTs 6 whose gate electrodes are connected to the gate bus line 2 are turned on. The grayscale voltages are applied to the pixel electrodes 8 connected to the source electrodes of those TFTs 6 to drive a liquid crystal 10 between the pixel electrodes 8 and a common electrode 12 formed on the opposite substrate 14.

Figure 2:
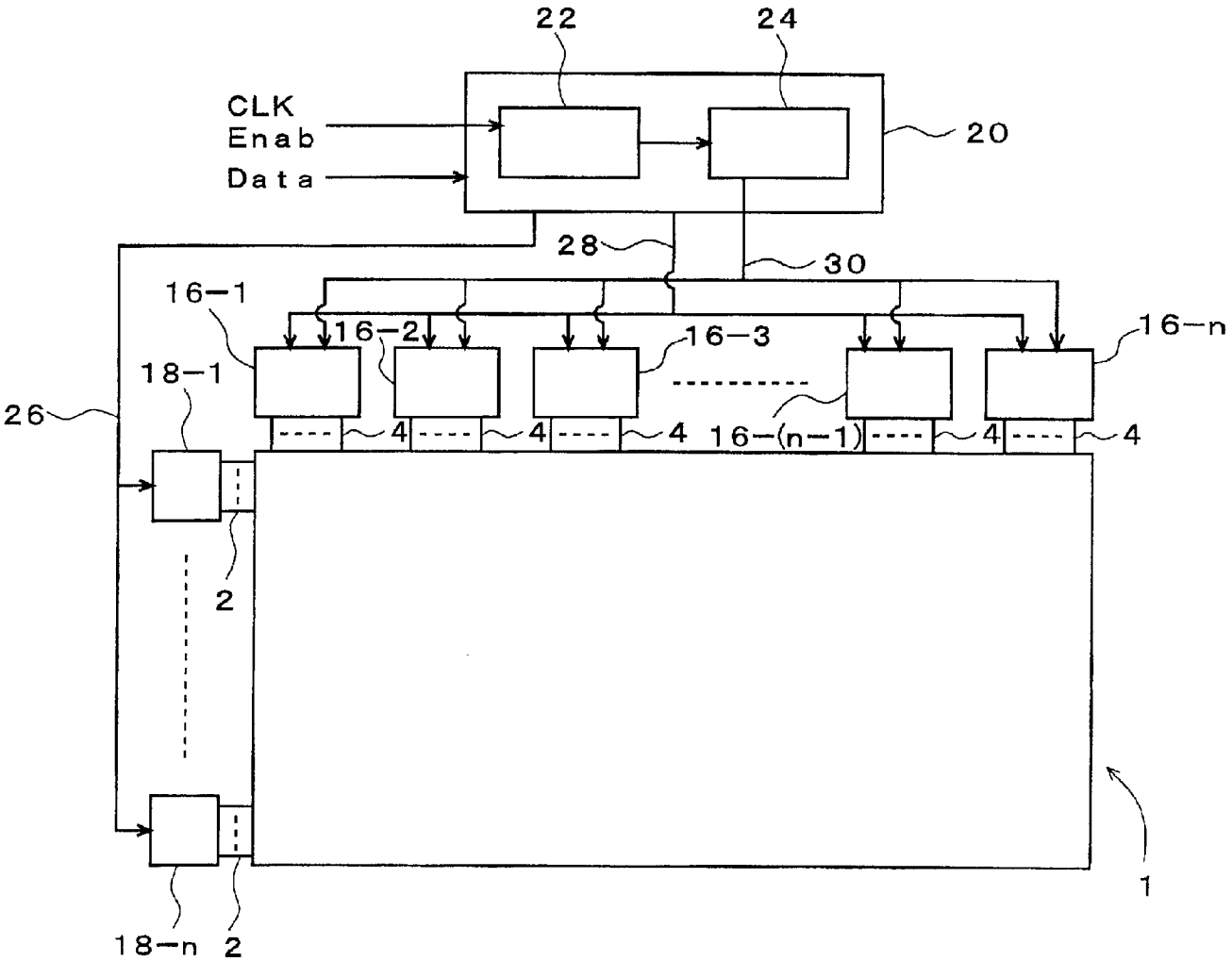
FIG. 2 is an illustration of a schematic configuration of a liquid crystal display utilizing data drivers according to the embodiment of the invention.

A schematic configuration of a display driving system of a liquid crystal display according to the present embodiment will now be described with reference to FIG. 2. FIG. 2 shows the liquid crystal display as viewed from above a panel thereof, and the configuration of pixels on an array substrate 1 and etc. of the display will not be described because they are the same as those shown in FIG. 1.

As shown in FIG. 2, a plurality of data drivers 16-1 through **16-*n* (listed in an order starting with the leftmost driver) for respectively outputting data signals to the plurality of data bus lines 4 are connected to the array substrate 1 at the upper side of the panel using, for example, TAB (tape-automated bonding). Similarly, a plurality of gate drivers 18-1 through 18-*n* (listed in an order starting with the uppermost driver) are provided on the left side of the panel. The gate drivers 18-1 through 18-*n* are connected to a timing controller 20 for outputting gate driver control signals through a signal line 26**.

A clock CLK, data enable signals Enab, grayscale data Data, etc. output by a system such as a PC (personal computer) are input to the timing controller 20.

The timing controller 20 has a horizontal counter 22 and a vertical counter 24. The horizontal counter 22 counts the number of dot clocks DCLK generated based on the external clock CLK. The vertical counter 24 counts the number of the data enable signals Enab. Values output by the horizontal and vertical counters 22 and 24 are input to a decoder (not shown). The decoder outputs various control signals based on the values.

The timing controller 20 outputs gate clocks GCLK and gate start signals GST as gate driver control signals. The gate clocks GCLK and gate start signals GST are output based on a horizontal period which is obtained by counting the number of dot clocks DCLK from a falling edge or rising edge of a data enable signal Enab using the horizontal counter 22. The gate start signal GST is output based on a vertical period which is obtained by counting the number of data enable signals Enab using the horizontal counter 24.

The timing controller 20 outputs the dot clocks DCLK, latch pulses LP, polarity signals POL and data start signals DST as data driver control signals. The latch pulses LP, polarity signals POL and data start signals DST are output based on the above-described horizontal period obtained by the horizontal counter 22. Those control signals are output to the data drivers 16-1 through **16-*n* through a control line 30. The grayscale data Data are input to the data drivers 16-1 through 16-*n* through a data line 28**.

Figure 3:
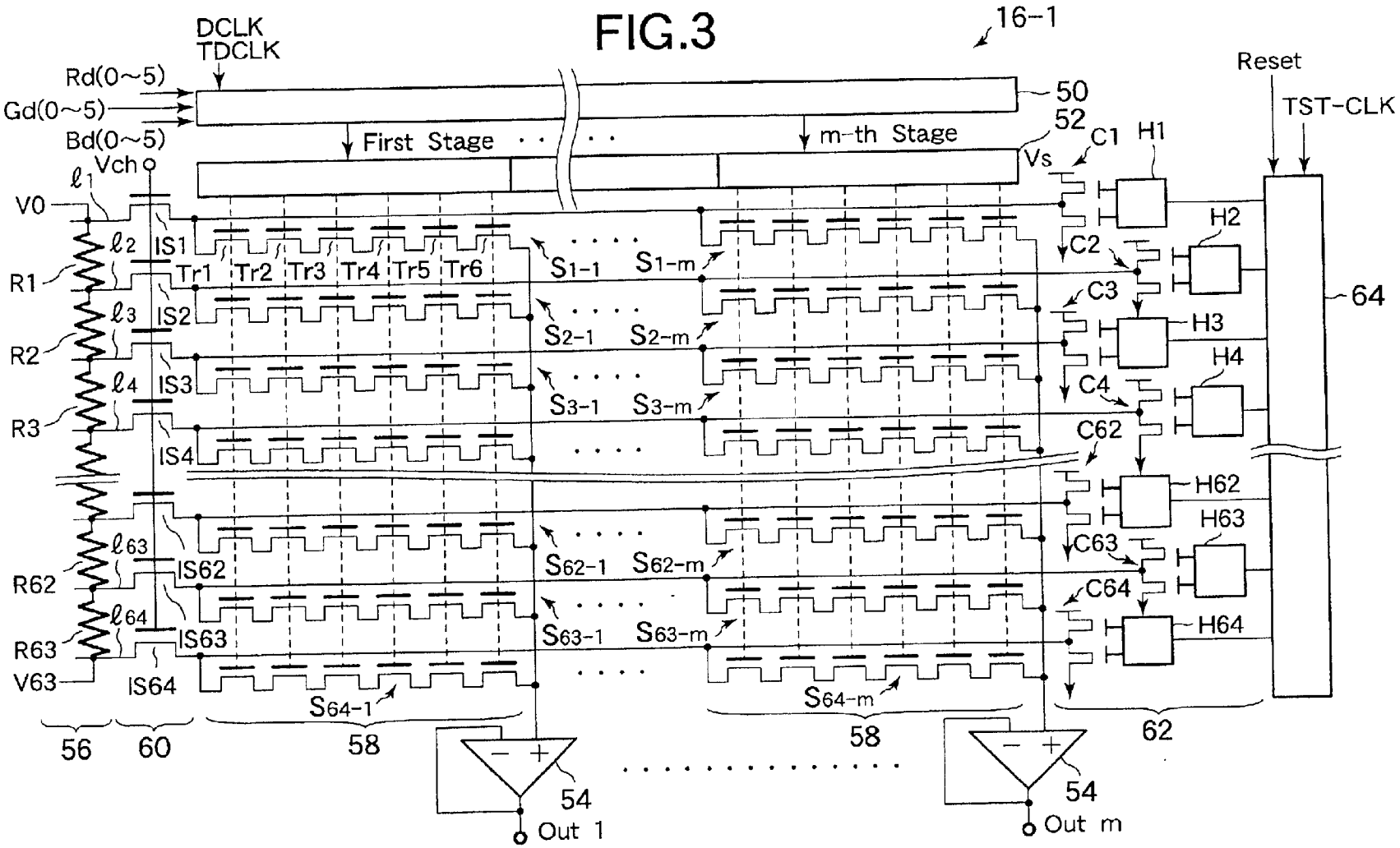
FIG. 3 is an illustration of a schematic configuration of the data driver according to the embodiment of the invention.

The data drivers 16-1 through **16-*n* will now be described in more detail. FIG. 3 schematically shows a configuration of the data driver 16-1. The other data drivers 16-2 through 16-*n* will not be described because they have the same configuration as the data driver 16-1**.

The data driver 16-1 has a shift register 50 to which the grayscale data Data output to the data line 28 shown in FIG. 28 are input. For example, the grayscale data Data are red (R) data Rd (0–5), green (G) data Gd (0–5) and blue (B) data Bd (0–5) each of which consists of six bits, which makes it possible to display 64 grayscales for each color.

The shift register 50 has m stages (e.g., 384 stages), which allows the single data driver 16-1 to output grayscale data to 384 data bus lines (when m=384). The shift register 50 sequentially fetches the grayscale data Data into the stages in synchronism with, for example, rising edges of the dot clocks DCLK output to the control line 30 shown in FIG. 2.

An output terminal of each of the first through m-th stages of the shift register 50 is connected to a latch circuit 52 provided downstream thereof. When the grayscale data Data are stored in all stages of the shift register 50 and a latch pulses LP is output to the control line 30, the latch circuit 52 latches the grayscale data in each stage of the shift register 50.

A reference voltage selection circuit is provided downstream of the latch circuit 52. The reference voltage selection circuit has a selector portion 58 provided for each of the data bus lines and a grayscale voltage generating portion, e.g., a ladder resistor portion 56 for generating analog grayscale voltages at 64 levels which are supplied to the data bus lines.

The ladder resistor portion 56 is provided by connecting 63 resistors R1 through R63 in series. A voltage V0 is applied to one terminal of the resistor R1, and a voltage V63 is applied to one terminal of the resistor R63. A grayscale voltage line l1 for supplying the voltage V0 to the selector portions 58 is extended from the ladder resistor portion 56. A grayscale voltage line l64 for supplying the voltage V63 to the selector portions 58 is also extended. Grayscale voltage lines l2 through l63 are extended from connecting points between the adjoining resistors by connecting taps thereto, and voltages at 64 levels from the voltage V0 up to the voltage V63 are supplied to the selector portions 58 through the grayscale voltage lines l1 through l64 as a result of resistance division.

The selector portions 58 will now be described. For example, the selector portion 58 for the first data bus line has 64 decoders S1-1 through S64-1. Each of the decoders S1-1 through S64-1 has six switching elements Tr1 through Tr6 which are constituted by, for example, p-channel type MOSFETs (Metal Oxide Semiconductor Field Effect Transistors). The drain electrodes (or the source electrodes; the following description will refer to the drain electrodes) of the first switching elements Tr1 of the decoders S1-1 through S64-1 are sequentially connected to the 64 grayscale voltage lines l1 through l64 extended from the ladder resistor portion 56.

The source electrodes of the switching elements Tr1 are connected to the drain electrodes of the switching elements Tr2 at the subsequent stages. Similarly, the switching elements Tr1 through Tr6 are connected in series in the same order, and the source electrode of the switching element Tr6 is connected to a first output line Out1. The output line Out1 is connected to a first data bus line through a buffer 54.

The gate electrode of the switching element Tr1 is connected to either of bit lines D1 and /D1 for the first bit of grayscale data consisting of six bits held for the first data bus line in the latch circuit 52. The symbol "/" indicates that the bit line is activated by a signal at a low (L) level. Similarly, the gate electrodes of the switching elements Tr2 through Tr6 of the decoders S1-1 through S64-1 are sequentially connected to bit lines D2 (or /D2) through D6 (or /D6) of the second through sixth bits of the grayscale data consisting of six bits held for the first data bus line in the latch circuit 52.

Similarly, the selector portion 58 for the m-th data bus line has 64 decoders S**1-*m* through S64-*m*. Each of the decoders S1-*m* through S64-*m* has six switching elements Tr1 through Tr6 which are constituted by, for example, p-channel type MOSFETs. The drain electrodes of the switching elements Tr1 of the decoders S1-*m* through S64-*m* are sequentially connected to the 64 grayscale voltage lines l1 through l64 extended from the ladder resistor portion 56**.

The source electrodes of the switching elements Tr1 of the decoders S**1-*m* through S64-*m* are connected to the drain electrodes of the switching elements Tr2 at the subsequent stages. Similarly, the switching elements Tr1 through Tr6 are connected in series in the same order, and the source electrode of the switching element Tr6 is connected to an m-th output line Outm. The output line Outm is connected to an m-th data bus line through a buffer 54**.

The gate electrode of the switching element Tr1 is connected to either of bit lines D1 and /D1 for the first bit of grayscale data consisting of six bits held for the m-th data bus line in the latch circuit 52. Similarly, the gate electrodes of the switching elements Tr2 through Tr6 of the decoders S**1-*m* through S64-*m* are sequentially connected to bit lines D2 (or /D2) through D6 (or /D6) of the second through sixth bits of the grayscale data consisting of six bits held for the m-th data bus line in the latch circuit 52**.

Although not described in detail, the bit lines D or /D connected to the gate electrodes of the switching elements Tr1 through Tr6 of the decoders S1-1 through S64-1 may be appropriately selected and connected to select one of the voltages at 64 levels in accordance with the grayscale data held in the latch circuit 52. On the first data bus line, for example, all of the switching elements Tr1 through Tr6 of any one of the decoders S1-1 through S64-1 may be turned on in accordance with the grayscale data for the first data bus line held in the latch circuit 52, and at least one of the switching elements Tr1 through Tr6 of the other decoders may be turned off.

As a result, a desired analog grayscale voltage can be output to the first data bus line from the grayscale voltage line l connected to the decoder whose switching elements Tr1 through Tr6 have been all turned on. A desired analog grayscale voltage can be selected and output to the m-th data bus line through completely the same operation.

The analog grayscale voltage output to the output line Out1 is applied to the drain electrode of a pixel TFT (not shown) connected to the first data bus line through the buffer 54. The grayscale voltage output to the output line Outm is applied to the drain electrodes of pixel TFTs (not shown) connected to the m-th data bus line through the buffer 54. The grayscale voltages are applied from pixel TFTs which have been turned on by gate pulse transmitted to a predetermined gate bus line to the pixel electrodes respectively, thereby performing grayscale display for one gate bus line.

In order to prevent deterioration of the liquid crystal, a grayscale voltage applied to the liquid crystal is normally subjected to the so-called inversion (alternate) driving in which the polarity of the voltage is inverted for each frame. Therefore, the data drivers have a configuration including a ladder resistor and decoders such that 64 levels each can be output with a positive polarity (+V) and negative polarity (−V) relative to a common potential. For simplicity of description, FIG. 3 shows only the configuration of the positive polarity side.

The data driver 16 according to the present embodiment has a configuration as described below in addition to the above-described configuration. The configuration described below is used for performance evaluation and functional tests at the final stage of the manufacturing steps for the data driver of the present embodiment.

First, a select switch portion 60 for electrically connecting or disconnecting the ladder resistor portion 56 and selector portions 58 is provided in the reference voltage selection circuit. The select switch portion 60 has switching elements ls1 through ls64 having, for example, a MOSFET structure which are provided on respective grayscale voltage lines l1 through l64 between the ladder resistor portion 56 and selector portions 58.

The ladder resistor portion 56 and selector portions 58 can be electrically connected by simultaneously turning all of the switching elements ls1 through ls64 on and can be electrically disconnected by simultaneously turning them off.

Gate electrodes of the switching elements ls1 through ls64 are commonly connected, and the turning on/off of the gates can be controlled by the level of a switching signal Vch applied from a tester which is not shown. When the switching elements ls1 through ls64 are constituted by p-channel type MOSFETs, the switching elements ls1 through ls64 can be maintained in the off-state by keeping the switching signal Vch at the "H" level to electrically disconnect the ladder resistor portion 56 and selector portions 58.

At the end of wiring of the grayscale voltage lines l1 through l64 opposite to the ladder resistor portion 56, there is provided a state setting circuit 62 for setting each of the grayscale voltage lines l1 through l64 at the "H" or "L" level or setting the ends of the grayscale voltage lines l1 through l64 in a high impedance state.

The state setting circuit 62 has switching elements C1 through C64 for state switching having, for example, a CMOS structure which are connected to the grayscale voltage lines l1 through l64, respectively. The source electrodes of the p-channel MOSFETs of the switching elements C1 through C64 for state switching are connected to a state setting power supply Vs provided in a tester which is not shown, and the source electrodes of the n-channel MOSFETs are connected to the ground. The gate electrodes of the p-channel MOSFETs and n-channel MOSFETs of the switching elements C1 through C64 for state switching are connected to state switching circuits H1 through H64, respectively.

For example, to set the grayscale voltage line l1 at the "H" level when the ladder resistor portion 56 and selector portions 58 are electrically disconnected to put the grayscale voltage lines l1 through l64 in a floating state, the state switching circuit H1 inputs "L" to the gate electrodes of the p-channel MOSFET and n-channel MOSFET of the switching element C1 for state switching to turn on the p-channel MOSFET and to turn off the n-channel MOSFET. Thus, the grayscale voltage line l1 can be set at the "H" level in accordance with the state setting power supply Vs.

Similarly, to set the grayscale voltage line l1 at the "L" level, the state switching circuit H1 inputs "H" to the gate electrodes of the p-channel MOSFET and n-channel MOSFET of the switching element C1 for state switching to turn off the p-channel MOSFET and to turn on the n-channel MOSFET. Thus, the grayscale voltage line l1 can be set at the "L" level in accordance with the ground potential.

Similarly, to set the output state of the switching element C1 for state switching at "Hiz", the state switching circuit H1 inputs "H" to the gate electrode of the p-channel MOSFET of the switching element C1 for state switching and "L" to the gate electrode of the n-channel MOSFET of the same to turn off both the p-channel MOSFET and n-channel MOSFET. Thus, the end of the grayscale voltage line l1 can be set in a high impedance state.

Each of the other grayscale voltage lines l2 through l64 can be set in the "H" or "L" state in the same way as described above. Alternatively, the ends of the lines can be put in the high impedance state.

The state setting circuit 62 is connected to a test control portion 64 incorporating a shift register (not shown) which operates in synchronism with a test clock TST-CLK supplied from the tester which is not shown. The test control portion 64 sequentially transmits control signals to the state switching circuits H1 through H64, for example, in accordance with sequential output of shift clocks in synchronism with rising edges of the test clock TST-CLK from the shift register which is not shown. The state switching circuits H1 through H64 are connected to the test control portion 64 in the order of the output of the shift clocks from the shift register.

During a test, the state switching circuits H1 through H64 can sequentially receive the control signals from the test control portion 64 to set input to any of the switching elements C1 through C64 for state switching at the "L" level and to sequentially set the grayscale voltage signal lines l1 through l64 at the "H" level only one at a time.

A reset signal Reset from the tester which is not shown is input to the test control portion 64 in addition to the test clock TST-CLK. When the reset signal Reset is input, the shift register in the test control portion 64 is reset, and all of the state switching circuits H1 through H64 output the "H" level to set all of the grayscale voltage lines l1 through l64 at the "L" level.

A description will now be made on operations at performance evaluation and functional tests at steps for manufacturing the data driver according to the present embodiment.

First, at the select switch portion 60 provided between the ladder resistor portion 56 and selector portions 58 in the reference voltage selection circuit, all of the switching elements ls1 through ls64 formed between the ladder resistor portion 56 and selector portions 58 of the grayscale voltage lines l1 through l64 are simultaneously turned off.

As a result, the ladder resistor portion 56 and selector portions 58 are electrically disconnected to maintain the grayscale voltage lines l1 through l64 in a floating state. When the switching elements ls1 through ls64 are constituted by p-channel MOSFETs, a switching signal Vch="H"

is applied from the tester which is not shown to turn the switching elements ls1 through ls64 off, which electrically disconnects the ladder resistor portion 56 and selector portions 58.

Next, the switching elements C1 through C64 for state switching are connected to the state setting power supply Vs of the tester and the ground.

First, the test control portion 64, shift register 50 and other circuits are initialized by the reset signal Reset transmitted from the tester to the data driver 16. In the initialized state, "H" is input to all of the switching elements C1 through C64 for state switching by the state switching circuits H1 through H64 and, as a result, all of the grayscale voltage lines l1 through l64 are set at the "L" level which is in accordance with the ground potential.

During a test, a testing dot clock TDCLK at a speed higher than that in a normal operation is input to the shift resistor 50. In synchronism with the testing dot clock TDCLK, grayscale data for the same grayscale consisting of six bits (e.g., the first grayscale "000000" of 64 grayscales) are input m (=384) times to the shift register 50. When the input of the m items of data for the same grayscale to the shift register 50 is completed, a test clock TST-CLK generated from the testing dot clock TDCLK is input to the latch circuit 52 instead of the latch pulse LP to latch the m items of grayscale data. As a result, the switching elements Tr1 through Tr6 of the first decoders S1-1 through S1-*m* of all of the selector portions 58 are turned on.

The test control portion 62 outputs a control signal to the state switching circuit H1 connected to the grayscale voltage line l1 (to which an analog voltage associated with the first grayscale is supplied from the ladder resistor portion 56 during a normal operation) in synchronism with the input of the test clock TST-CLK. As a result, the state switching circuit H1 outputs "L" to the switching element C1 for state switching to turn on the p-channel MOSFET and turn off the n-channel MOSFET. The grayscale voltage lines l2 through l64 are maintained at the "L" level, and only the grayscale voltage line l1 is set at the "H" level which is in accordance with the state setting power supply Vs.

As a result of the above-described operation, a voltage in accordance with the state setting power supply Vs is measured at each of the output lines Out1 through Outm. An operation test of the data driver 16 can be carried out by monitoring the voltage at each of the output lines Out1 through Outm. For example, referring to the output line Out1, only the grayscale voltage line l1 should be at the signal level "H" in the selector portion 58, and the decoder S1-1 should be the only decoder whose switching elements Tr1 through Tr6 are on. Therefore, if a voltage in accordance with the state setting power supply Vs is measured on the output line Out1, it can be judged that the relevant selector portion 58 is operating properly.

For example, if any of the switching elements Tr1 through Tr6 of the decoder S1-1 is defective and in the off-state, no desired voltage is applied to the output line Out1 from the decoder S1-1 and, therefore, a voltage which is considerably lower than the voltage in accordance with the state setting power supply Vs is measured on the output line Out1.

If any of the other decoders S2-1 through S64-1 is defective and if all of the switching elements Tr1 through Tr6 of the defective decoder are on, a voltage at the "L" level is superposed on the voltage in accordance with the state setting power supply Vs on the output line Out1 even if the decoder S1-1 is operating properly. As a result, a voltage lower than (e.g., about one half) a normal value is measured.

It is therefore possible to easily and instantaneously determine if the operation is being properly performed or not only by making a comparison to judge whether the voltage measured on the output line Out1 exceeds a predetermined threshold or not. The same measuring operation allows instantaneous determination on whether the operation is being properly performed or not also on the other output lines Out2 through Outm.

Next, in synchronism with the testing dot clock TDCLK, grayscale data for the same grayscale consisting of six bits (e.g., the second grayscale "000001" of 64 the grayscales) are input m (=384) times to the shift register 50. When the input of the m items of data for the same grayscale to the shift register 50 is completed, the m items of grayscale data are latched in the latch circuit 52 in synchronism with the test clock TST-CLK. As a result, the switching elements Tr1 through Tr6 of the second decoders S2-1 through S2-*m* of all of the selector portions 58 are turned on.

The test control portion 62 outputs a control signal to the state switching circuit H1 connected to the grayscale voltage line l1 and outputs "H" to the switching element C1 for state switching to turn off the p-channel MOSFET and turn on the n-channel MOSFET. As a result, the grayscale voltage line l1 is set at the "L" level, and all of the grayscale voltage lines l1 through l64 are therefore set at the "L" level again.

Next, in synchronism with the input of the test clock TST-CLK, the test control portion 62 outputs a control signal to the state switching circuit H2 connected to the grayscale voltage line l2 (an analog voltage associated with the second grayscale is supplied from the ladder resistor portion 56 during a normal operation).

As a result, the state setting circuit H2 outputs "L" to the switching element C2 for state switching to turn on the relevant p-channel MOSFET and turn off the n-channel MOSFET. Thus, the grayscale voltage lines l1 and l3 through l64 are maintained at the "L" level, and only the grayscale voltage line l2 is set at the "H" level which is in accordance with the state setting power supply Vs.

An operation test of the data driver 16 can be carried out in the same manner as described above by measuring the output voltage from each of the output lines Out1 through Outm through the above-described operation. By repeating the above-described testing operation for 64 grayscales in total, it is possible to check whether all of the selector portions 58 are good or not. It is also possible to evaluate the performance of the shift register 50 and latch circuit 52 simultaneously.

Thus, the test of the data driver according to the present embodiment can be carried out without using analog grayscale voltages from the ladder resistor portion 56 by electrically isolating the ladder resistor portion 56. Since this therefore eliminates the need for monitoring the output of the output lines Out1 through Outm after the levels of the analog grayscale voltages are sufficiently stabilized as in the prior art, the test can be carried out in a short time by switching grayscale data at a high speed. Therefore, even when the above-described operation is repeated for a multiplicity of decoders S, the test can be completed in a short time.

Furthermore, since there is no need for connecting a tester having high accuracy to each of the output lines Out1 through Outm even when a grayscale voltage difference between the analog grayscale voltages generated at the ladder resistor portion 56 becomes small as a result of an increase in the number of grayscales, the cost required for the test can be kept low.

A brief description will now be made on a stress voltage application test according to the present embodiment. As already described, a stress voltage application test is carried out to reject any data driver in which foreign substances have been deposited between adjoining grayscale voltage lines but have not resulted in a short-circuit at a manufacturing step. For this purpose, first, the voltage of the state setting power supplies Vs of the switching elements C1 through C64 for state switching respectively connected to the grayscale voltage lines l1 through l64 is set relatively high (for example, at about +8 V).

Next, the voltage of the state setting power supply Vs is sequentially applied to the grayscale voltage lines l1 through l64 one at a time in the same way as that for the above-described operation test. Thus, a relatively big potential difference can be generated between the adjoining grayscale voltage lines to conduct a stress test.

According to the present embodiment, since a stress test can be thus performed easily, it is possible to reliably prevent any data driver that may become defective as time passes from being mounted on a liquid crystal panel.

A good data driver 16 on which the above-described operation test has been completed can be enabled for a normal operation according to the following procedure.

First, at the select switch portion 60 provided between the ladder resistor portion 56 and selector portions 58 in the reference voltage selection circuit, all of the switching elements ls1 through ls64 formed between the ladder resistor portion 56 and selector portions 58 of the grayscale voltage lines l1 through l64 are simultaneously turned on.

As a result, the ladder resistor portion 56 and selector portions 58 are electrically connected to apply analog grayscale voltages from the ladder resistor portion 56 to the grayscale voltage lines l1 through l64. When the switching elements ls1 through ls64 are constituted by p-channel MOSFETs, a switching signal Vch="L" is applied from a system to turn the switching elements ls1 through ls64 on, which electrically connects the ladder resistor portion 56 and selector portions 58.

The state switching circuits H1 through H64 set the gates of the p-channel MOSFETs of the switching elements C1 through C64 for state switching at the "H" level and set the gates of the n-channel MOSFETs at the "L" level to turn both of the p-channel MOSFETs and n-channel MOSFETs off. As a result, the output state of all of the switching elements C1 through C64 for state switching can be set at "Hiz" to keep the ends of the grayscale voltage lines l1 through l64 at in a high impedance state.

The above setting makes it possible to use the data driver according to the present embodiment in a normal mode of operation.

A modification of the data driver according to the present embodiment will now be described with reference to FIG. 4. A liquid crystal display in which the present embodiment is used is the same as the active matrix liquid crystal display according to the first embodiment shown in FIGS. 1 and 2 and will not therefore be described. Components having the same functions and operations as those of the components described with reference to FIGS. 1 through 3 will be indicated by like reference numbers and will not be described.

Figure 4:
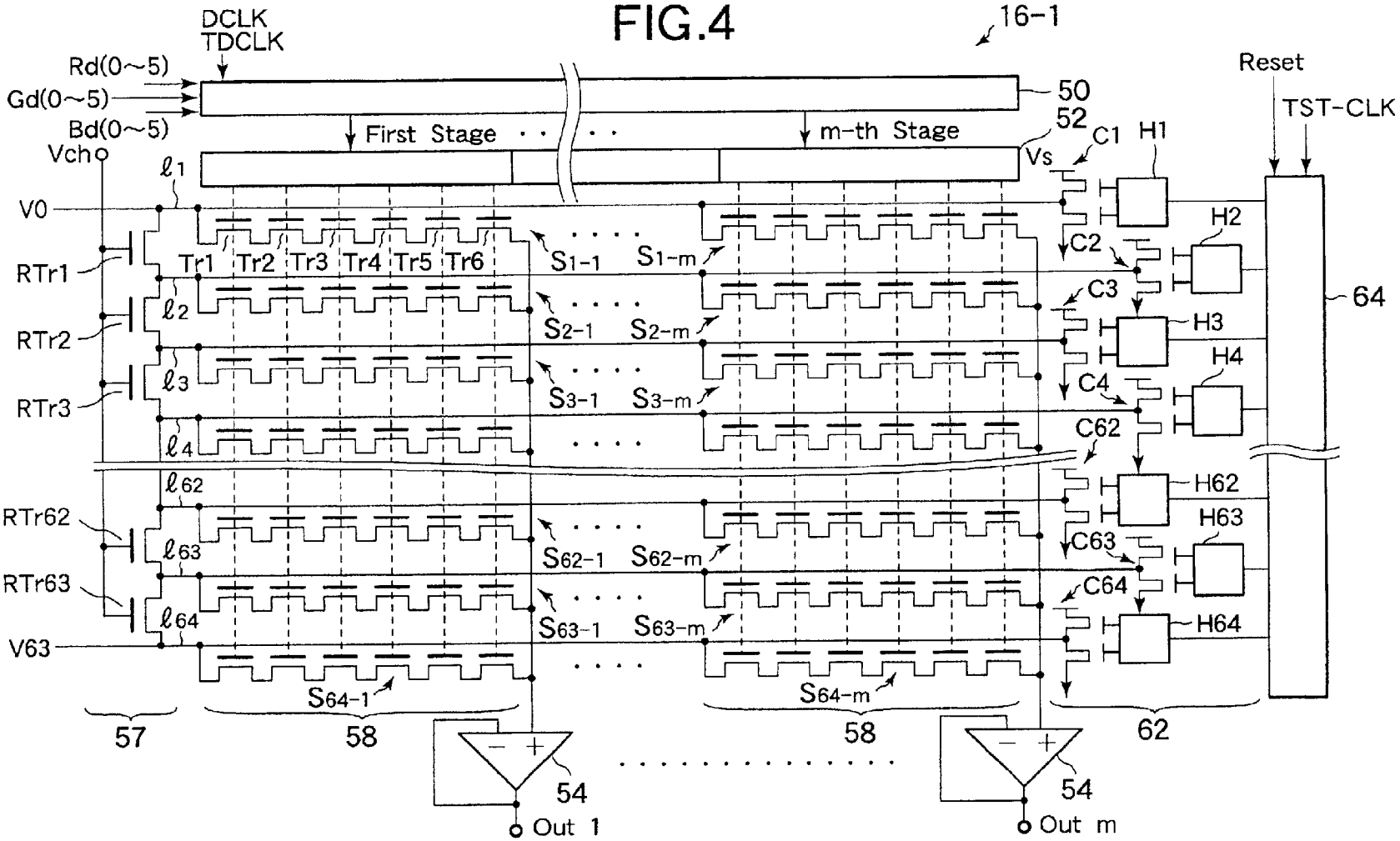
FIG. 4 is an illustration of a schematic configuration of a data driver according to a modification of the embodiment of the invention.

The data driver according to the present modification is characterized in that a ladder resistor portion 57 shown in FIG. 4 is provided in place of the ladder resistor portion 56 and select switch portion 60 of the data driver 16 shown in FIG. 3. The ladder resistor portion 57 as a grayscale voltage generating portion has 63 MOS transistors RTr1 through RTr63 which are connected in series. The gate electrodes of the transistors RTr1 through RTr63 are commonly connected such that all of the transistors RTr1 through RTr63 can be simultaneously turned on or off by a switching signal Vch.

For example, a voltage V0 is applied to the drain electrode of the transistor RTr1 through the grayscale voltage line l1, and a voltage V63 is applied to the source electrode of the transistor RTr63 through the grayscale voltage line l64. Connected to the adjoining transistors RTr are the grayscale voltage lines l2 through l63 which are listed in an order starting with the uppermost one in the figure. The grayscale voltage lines l2 through l63 connected to connecting points between the adjoining transistors RTr using taps are extended to the selector portions 58.

When the transistors RTr1 through RTr64 are constituted by p-channel MOSFETs, the transistors RTr1 through RTr63 are maintained in an on-state by keeping the switching signal Vch at the "L" level to form a ladder resistance with on-resistances of the transistors RTr1 through RTr63, and voltages at 64 levels from the voltage V0 up to V63 are supplied to the grayscale voltage lines l1 through l64, respectively.

The grayscale voltage lines l1 through l64 can be electrically disconnected by switching the switching signal Vch to the "H" level to turn the transistors RTr1 through RTr63 off. The circuit configuration of the present modification is otherwise the same as the configuration of the above-described embodiment shown in FIG. 3 and, therefore, no further description is made on the same.

General operations of the data driver of the present modification during performance evaluation and functional tests at manufacturing steps are substantially the same as those described above with reference to FIGS. 1 through 3. However, the electrical isolation between the grayscale voltage lines l1 through l64 is achieved by turning off all of the transistors RTr1 through RTr63 using the switching signal Vch in the ladder resistor portion 57 as described above. During a test, no voltage is applied to the grayscale voltage lines l1 and l64.

Testing of such a data driver according to the present embodiment can be also carried out without using analog grayscale voltages from the ladder resistor portion 57. Therefore, the test can be carried out in a short time by switching grayscale data at a high speed similarly to the above-described embodiment. This makes it possible not only to complete the test in a short time but also to suppress the cost required for the test because there is no need for connecting a tester having high accuracy to each of output lines Out1 through Outm. Further, a stress voltage application test can be easily conducted just as in the above-described embodiment.

A good data driver 16 on which the above-described operation test has been completed can be enabled for a normal operation according to the following procedure. First, the voltage V0 is applied to the grayscale voltage line l1, and the voltage V63 is applied to the grayscale voltage line l64. Next, a predetermined switching signal Vch is input to the transistors RTr1 through RTr64 to turn the transistors RTr1 through RTr63 on, thereby forming a ladder resistance with on-resistances of the transistors RTr1 through RTr63. Voltages at 64 levels from the voltage V0 up to V63 are supplied to the grayscale voltage lines l1 through l64, respectively.

The output state of all of the switching elements C1 through C64 for state switching is set at "Hiz" to maintain the ends of the grayscale voltage lines l1 through l64 in a high impedance state. The above-described setting makes it possible to use the data driver according to the present embodiment in a normal mode of operation.

Another modification of the data driver according to the present embodiment will now be described with reference to FIG. 5. A liquid crystal display in which the present embodiment is used is the same as the active matrix liquid crystal display according to the first embodiment shown in FIGS. 1 and 2 and will not therefore be described. Components having the same functions and operations as those of the components described with reference to FIGS. 1 through 3 will be indicated by like reference numbers and will not be described.

Figure 5:
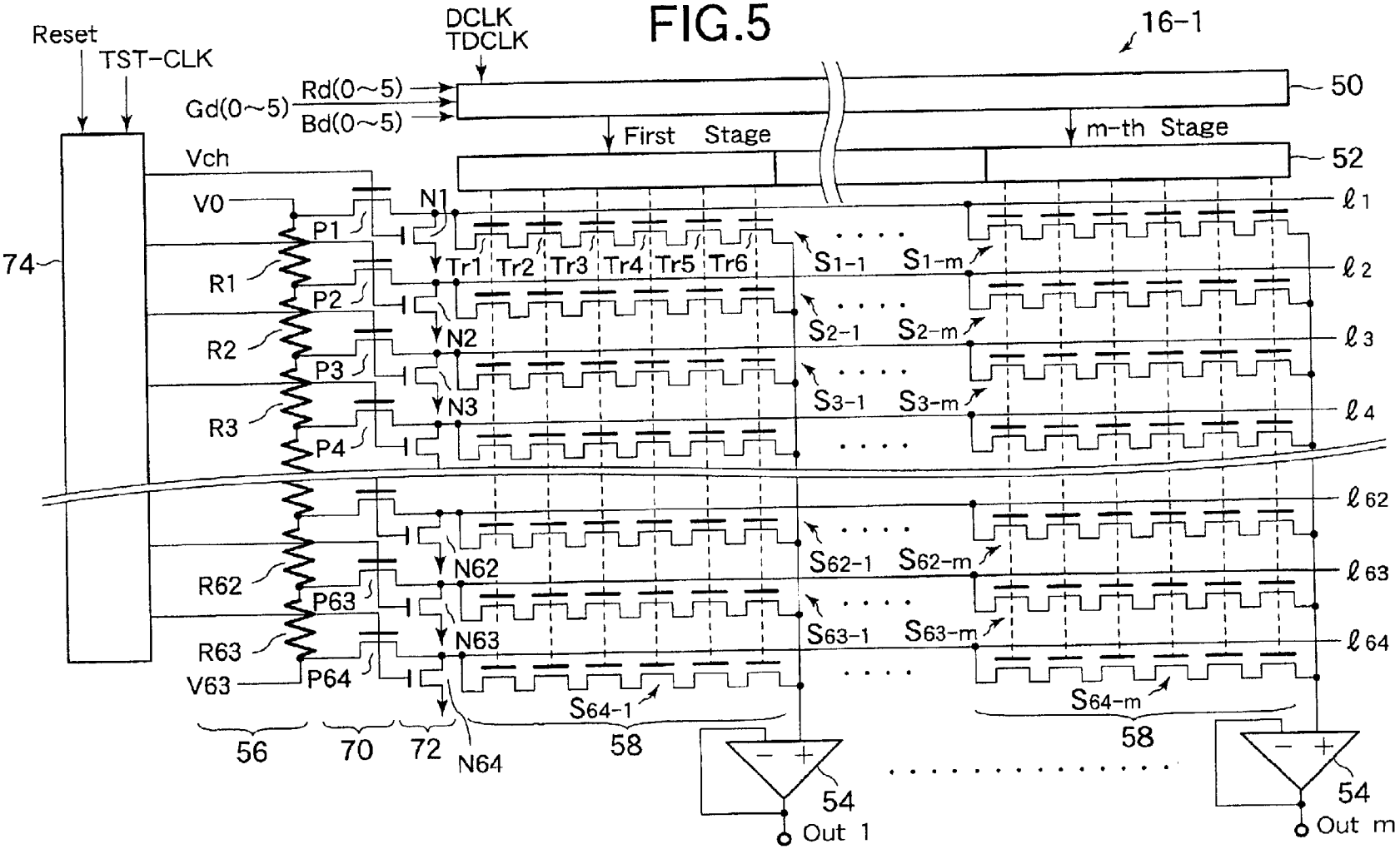
FIG. 5 is an illustration of a schematic configuration of a data driver according to another modification of the embodiment of the invention.

The data driver according to the present modification shown in FIG. 5 is characterized in that it has a select switch portion 70, state setting circuit 72 and test control portion 74 in place of the select switch portion 60, state setting circuit 62 and test control portion 64 of the data driver 16 shown in FIG. 3.

As shown in FIG. 5, a select switch portion 70 for electrically connecting or isolating a ladder resistor portion 56 and selector portions 58 is provided in a reference voltage selection circuit. The select switch portion 70 has switching elements P1 through P64, e.g., p-channel MOSFETs formed on grayscale voltage lines l1 through l64 between the ladder resistor portion 56 and selector portions 58.

A switching signal Vch is supplied to the gate electrode of each switching element P from a test control portion 74 to be described later in detail. When the switching elements P are constituted by p-channel MOSFETs, a switching element P to which a switching signal Vch at the "L" level is input is turned on. A grayscale voltage line l connected to a switching element P in the on-state is electrically connected to the ladder resistor portion 56. By setting the switching signal Vch at the "H" level to turn the switching element P off, the ladder resistor portion 56 and the grayscale voltage line l can be electrically disconnected.

Furthermore, the state setting circuit 72 for setting each of the grayscale voltage lines l1 through l64 at the "H" level or "L" level is provided at the grayscale voltage lines l1 through l64 between the ladder resistor portion 56 and selector portions 58. The state setting circuit 72 has switching elements N1 through N64 for state switching which are constituted by n-channel MOSFETs and which are connected to the grayscale voltage lines l1 through l64, respectively. The source (or drain) electrodes of the switching elements N1 through N64 for state switching are connected to the grayscale voltage lines l1 through l64, and the drain (or source) electrodes are grounded. The gate electrodes of the switching elements N1 through N64 for state switching are commonly connected to the gate electrodes of the switching elements P1 through P64 respectively such that the switching signal Vch is supplied from the test control portion 74.

For example, to set the grayscale voltage line l1 at the "H" level, the switching signal Vch is set at "L" to turn on the switching element P1 and to turn off the switching element N1 for state switching. As a result, the grayscale voltage line l1 electrically connected to the ladder resistor portion 56 can be put in the "H" state as a result of application of a predetermined voltage from the ladder resistor portion 56. During an operation test, the V0 side and V63 side of the ladder resistor portion 56 maybe set at the same potential, for example, on the order of +8 V to put the grayscale voltage line l1 in the "H" state reliably.

Similarly, to set the grayscale voltage line l1 at the "L" level, the switching signal Vch is set at "H" to turn off the switching element P1 and to turn on the switching element N1 for state switching. As a result, the grayscale voltage line l1 can be put in the "L" state because it is electrically disconnected from the ladder resistor portion 56 and it will be at the same potential as the ground potential of the switching element N1 for state switching.

The gate electrodes of the switching elements of the select switch portion 70 and state setting circuit 72 are connected to the test control portion 74. The test control portion 74 incorporates a shift register (not shown) which operates in synchronism with a test clock TST-CLK supplied from a tester which is not shown. The test control portion 74 sequentially transmits the switching signal Vch to the gate electrodes of the switching elements of the select switch portion 70 and state setting circuit 72 in accordance with sequential output of shift clocks from the shift register which is not shown in synchronism with, for example, rising edges of the test clock TST-CLK.

During a test, the select switch portion 70 and state setting circuit 72 can sequentially receive the switching signals Vch from the test control portion 74 to sequentially set the grayscale voltage lines l1 through l64 at the "H" level one at a time.

A reset signal Reset from the tester which is not shown is input to the test control portion 74 in addition to the test clock TST-CLK. When the reset signal Reset is input, the shift register in the test control portion 74 is reset. Simultaneously, the test control portion 74 sets switching signals Vch at "H" for all of the switching elements in the select switch portion 70 and state setting circuit 72 to set all of the grayscale voltage lines l1 through l64 at the "L" level.

A description will now be made on operations at performance evaluation and functional tests at steps for manufacturing the data driver according to the present modification.

First, the reset signal Reset is input from the tester which is not shown to the test control portion 74 to reset the shift registers in the test control portion 74, and the switching signal Vch is set at "H" for all of the switching elements in the select switch portion 70 and state setting circuit 72 to set all of the grayscale voltage lines l1 through l64 at the "L" level.

Further, terminals on the V0 side and V63 side of the ladder resistor portion 56 are connected to the tester which is not shown to set the potentials on the V0 side and V63 side at the same potential, for example, on the order of +8 V.

During a test, a testing dot clock TDCLK at a speed higher than that for a normal operation is input to the shift register 50. In synchronism with the testing dot clock TDCLK, grayscale data for the same grayscale consisting of six bits (e.g., the first grayscale "000000" of 64 grayscales) are input m (=384) times to the shift register 50. When the input of the m items of data for the same grayscale to the shift register 50 is completed, a test clock TST-CLK generated from the testing dot clock TDCLK is input to the latch circuit 52 instead of a latch pulse LP to latch the m items of grayscale data. As a result, switching elements the Tr1 through Tr6 of the first decoders S1-1 through S1-*m* of all of the selector portions 58 are turned on.

The test control portion 72 transmits a switching signal Vch="L" to the gate electrodes of the switching elements of the select switch portion 70 and state setting circuit 72 connected to the grayscale voltage line l1 (to which an analog voltage associated with the first grayscale is supplied from the ladder resistor portion 56 during a normal operation) in synchronism with the input of the test clock TST-CLK. As a result, the switching element P1 is turned on, and the switching element N1 for state switching is turned off. The grayscale voltage lines l2 through l64 are maintained at the "L" level, and only the grayscale voltage line l1 is set at the "H" level.

If the potentials at the terminals on the V0 side and V63 side of the ladder resistor portion 56 are set at the same potential, for example, on the order of +8 V as described above, a voltage of about +8 V is measured on each of the output lines Out1 through Outm through the above-described operation. An operation test of the data driver 16 can be performed in the same as described in the above embodiment by monitoring the voltage on each of the output lines Out1 through Outm. The method for determining whether the data driver is good or not during the operation test will not be described because it is the same as that in the above embodiment.

Next, in synchronism with the testing dot clock TDCLK, grayscale data for the same grayscale consisting of six bits (e.g., the second grayscale "000001" of the 64 grayscales) are input m (=384) times to the shift register 50. When the input of the m items of data for the same grayscale to the shift register 50 is completed, a test clock TST-CLK generated from the testing dot clock TDCLK is input to the latch circuit 52 instead of a latch pulse LP to latch the m items of grayscale data. As a result, switching elements the Tr1 through Tr6 of the second decoders S2-1 through S2-*m* of all of the selector portions 58 are turned on.

The test control portion 72 outputs a switching signal Vch="H" to the gate electrodes of the switching elements of the select switch portion 70 and state setting circuit 72 connected to the grayscale voltage line l1. As a result, the switching element P1 is turned off, and the switching element N1 for state switching is turned off. The grayscale voltage line l1 is set at the "L" level, and all of the grayscale voltage lines l1 through l64 are set at the "L" level again.

Next, the test control portion 72 transmits a switching signal Vch="L" to the gate electrodes of the switching elements of the select switch portion 70 and state setting circuit 72 connected to the grayscale voltage line l2 (to which an analog voltage associated with the second grayscale is supplied from the ladder resistor portion 56 during a normal operation) in synchronism with the input of the test clock TST-CLK. As a result, the switching element P2 is turned on, and the switching element N2 for state switching is turned off. The grayscale voltage lines l1 and l3 through l64 are maintained at the "L" level, and only the grayscale voltage line l2 is set at the "H" level.

An operation test of the data driver 16 can be carried out in the same manner as described above by measuring the output voltage from each of the output lines Out1 through Outm through the above-described operation. By repeating the above-described testing operation for 64 grayscales in total, it is possible to check whether all of the selector portions 58 are good or not. It is also possible to evaluate the performance of the shift register 50 and latch circuit 52 simultaneously.

Thus, the test of the data driver according to the present modification can be performed utilizing the ladder resistor portion 56. As apparent from the illustration in FIG. 5, it is therefore possible to fabricate a data driver which has a simpler structure and a smaller device area compared to the configuration of the above embodiment shown in FIG. 3. The data driver according to the present modification has the same advantages over conventional data drivers as those of the data driver according to the above embodiment.

Although not described, a stress voltage application test similar to that described above can be easily conducted also on the data driver according to the present embodiment.

A good data driver 16 on which the above-described operation test has been completed according to the present modification can be enabled for a normal operation according to the following procedure.

First, the terminals on the V0 side and V63 side of the ladder resistor portion 56 are connected to a predetermined power supply or ground to apply, for example, a voltage of 0 V to the V0 side of the ladder resistor portion 56 and a voltage of +5 V to the V63 side thereof.

Next, at the select switch portion 70 provided between the ladder resistor portion 56 and selector portions 58 in the reference voltage selection circuit, all of the switching elements P1 through P64 formed on the grayscale voltage lines l1 through l64 between the ladder resistor portion 56 and selector portions 58 are simultaneously turned on. As a result, the ladder resistor portion 56 and selector portions 58 are electrically connected to apply analog grayscale voltages from the ladder resistor portion 56 to the grayscale voltage lines l1 through l64.

Therefore, when the switching elements P1 through P64 are constituted by p-channel MOSFETs, a switching signal Vch="L" is applied from a system to turn on the switching elements P1 through P64, thereby electrically connecting the ladder resistor portion 56 and selector portions 58. Since the switching elements N1 through N64 are turned off at the same time, analog grayscale voltages from the ladder resistor portion 56 are applied to the grayscale voltage lines l1 through l64.

The above-described setting makes it possible to use the data driver according to the present embodiment in a normal mode of operation.

The present invention is not limited to the above-described embodiments and may be modified in various ways.

For example, while the grayscale data Data have been described as having six bits in the above embodiments, this is not limiting the invention, and the grayscale data Data may obviously have 3 bits, 8 bits or a different number of bits. The numbers of the stages of the shift register 50 and latch circuit 52, the number of the switching elements Tr of the reference voltage selection circuit and the number of the stages of the ladder resistor portion 56 may be appropriately changed in accordance with the number of the bits of grayscale data.

While the above embodiments have referred to examples of a data driver 16 which drives 384 data bus lines, the invention is not limited thereto and may be applied to data drivers which drive an arbitrary number of data bus lines.

Figure 6:
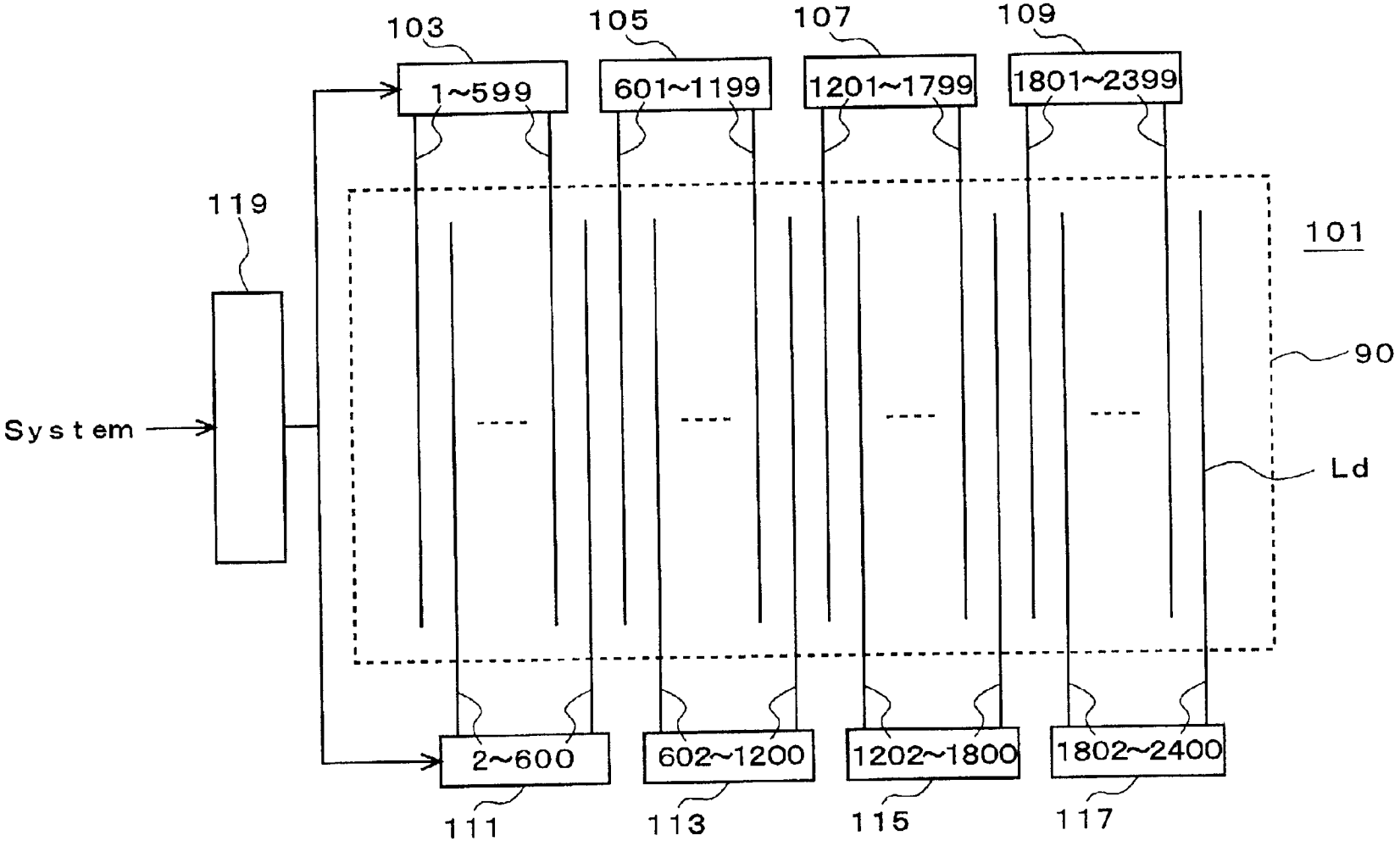
FIG. 6 is an illustration of a schematic configuration of a conventional liquid crystal display.
Figure 7:
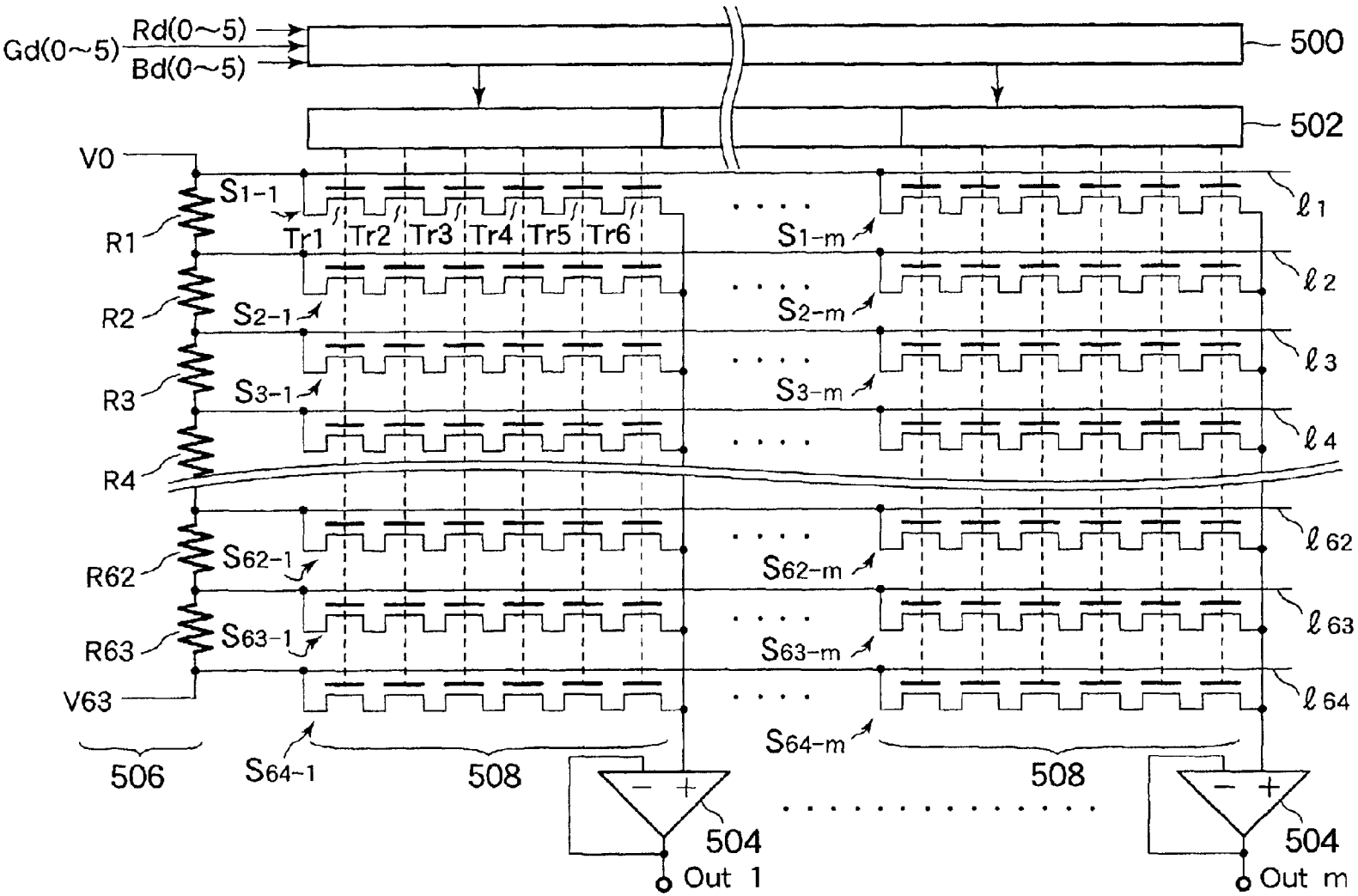
FIG. 7 is an illustration of a conventional data driver.

While the above embodiments have described configurations in which data drivers 16 are provided at only one end of a panel, the invention is not limited thereto and may obviously applied to panels having data drivers 16 provided on both ends thereof as shown in FIG. 6.

While the above embodiments have referred to examples in which the present invention is applied to active matrix liquid crystal displays, the invention is not limited thereto and may be applied to other displays, e.g., EL (electroluminescence) displays.

Amorphous silicon or polysilicon may be used for the active semiconductor layers of the TFTs used in the liquid crystal displays in the above embodiments.

As described above, the present invention makes it possible to provide a data driver on which an operation test can be easily and reliably conducted at the stage of manufacture and to reduce the testing time and a liquid crystal display utilizing the same.

What is claimed is:

1. A data driver outputting a plurality of analog grayscale voltages to a plurality of data bus lines, comprising:

a grayscale voltage generating portion generating the plurality of analog grayscale voltages for a predetermined number of grayscales;

a selector portion provided for each of the data bus lines and selecting any one of the plurality of analog grayscale voltages based on grayscale data;

a plurality of grayscale voltage lines connected to the grayscale voltage generating portion and provided for each of the plurality of analog grayscale voltages and supplying the analog grayscale voltages to the selector portion; and a switching portion electrically disconnecting the plurality of grayscale voltage lines from the grayscale voltage generating portion during an operation test and electrically connecting the plurality of grayscale voltage lines to the grayscale voltage generating portion during a normal mode of operations;

a state setting circuit setting each of the plurality of grayscale voltage lines at a "High" level or a "Low" level independently during the operation test; and a testing control portion for controlling the state selling circuit during the operation test to set a predetermined one of the plurality of grayscale voltage lines at the "High" level, and to set the rest of the plurality of grayscale voltage lines at the "Low" level.

2. A data driver according to claim 1, wherein the grayscale voltage generating portion has a ladder resistor portion which has a plurality of resistors connected in series and which generates the plurality of analog grayscale voltages through resistance division.

3. A data driver according to claim 1, wherein the grayscale voltage generating portion has a ladder resistor portion which has a plurality of transistors connected in series and which generates the plurality of analog grayscale voltages through resistance division utilizing on-resistances of the transistors.

4. A data driver according to claim 1, wherein the state setting circuit maintains ends of the plurality of grayscale voltage lines in a high impedance state during a normal operation.

5. A data driver according to claim 4, wherein the state setting circuit is provided at ends of wiring of the plurality of grayscale voltage lines opposite to the grayscale voltage generating portion.

6. A data driver according to claim 5, wherein the state setting circuit has:

a plurality of switching elements for state switching having a CMOS structure whose output ends are connected to the end of wiring of each of the plurality of grayscale voltage lines; and a plurality of state switching circuits which are connected to input ends of the switching elements for state switching and which set the output state of each of the plurality of switching elements for state switching in a "High", "Low" or "Hiz" state.

7. A data driver according to claim 1, wherein the testing control portion controls the state setting circuit during the operation test to sequentially set the plurality of grayscale voltage lines at the "High" level one at a time.

8. A data driver according to claim 1, wherein the state setting circuit has a plurality of switching elements for state switching which are respectively connected to the plurality of grayscale voltage lines between the grayscale voltage generating portion and the selector portion.

9. A data driver according to claim 8, wherein the testing control portion controls the state setting circuit during the operation test to sequentially set the plurality of grayscale voltage lines at the "High" level one at a time.

10. A display having a plurality of data bus lines and displaying images, comprising a data driver according to any one of claims 1 through 9 which outputs an analog grayscale voltage to the plurality of data bus lines.

* * * * *